US009409314B2

(12) United States Patent
Bourget

(10) Patent No.: US 9,409,314 B2
(45) Date of Patent: Aug. 9, 2016

(54) CONCRETE POWER SAW

(71) Applicant: Kyle Bourget, Augusta, KS (US)

(72) Inventor: Kyle Bourget, Augusta, KS (US)

( * ) Notice: Subject to any disclaimer, the term of this patent is extended or adjusted under 35 U.S.C. 154(b) by 0 days.

(21) Appl. No.: 14/715,209

(22) Filed: May 18, 2015

(65) Prior Publication Data

US 2015/0246461 A1 Sep. 3, 2015

(51) Int. Cl.
*B28D 7/02* (2006.01)
*B28D 1/04* (2006.01)

(52) U.S. Cl.
CPC . *B28D 7/02* (2013.01); *B28D 1/045* (2013.01)

(58) Field of Classification Search
None
See application file for complete search history.

(56) References Cited

U.S. PATENT DOCUMENTS 1,495,430 A * 5/1924 Parker ..... B23D 45/024 124/14
4,241,505 A 12/1980 Bodycomb, Jr. et al.
4,253,362 A 3/1981 Olson
4,255,995 A 3/1981 Connor
4,326,864 A 4/1982 Sittler
6,318,352 B1 11/2001 Gnazzo et al.
6,557,261 B1 5/2003 Buser et al.
6,748,660 B2 6/2004 Buser et al.
6,925,919 B2 8/2005 Liao et al.
7,013,884 B2 3/2006 Guth
7,246,406 B2 7/2007 Yarbrough et al.
7,654,181 B2 2/2010 Quinlan
7,802,505 B2 9/2010 Hetcher et al.
7,824,247 B1 11/2010 Bar-Cohen et al.
8,381,711 B2 2/2013 Loveless
8,650,997 B1 2/2014 Simon
8,752,462 B2 6/2014 Frolov
8,857,421 B2 10/2014 Kondo et al.
2006/0060179 A1* 3/2006 Kingsley ..... B23D 47/12 125/13.01
2006/0191526 A1* 8/2006 Markley ..... B23D 47/02 125/13.01
2006/0272464 A1 12/2006 Chen
2007/0164599 A1* 7/2007 Johnson ..... E01C 23/0933 299/39.6
2009/0236900 A1 9/2009 Due et al.
2010/0269353 A1 10/2010 Martin
2015/0013513 A1 1/2015 Merck et al.

FOREIGN PATENT DOCUMENTS

WO WO 2006031236 3/2006

* cited by examiner

*Primary Examiner* — Joseph J Hail
*Assistant Examiner* — Marc Carlson
(74) *Attorney, Agent, or Firm* — Kenneth H. Jack; Davis & Jack, L.L.C.

(57) ABSTRACT

A concrete saw for cutting a concrete slab incorporating a rollable trolley having upper, lateral, front, and rear ends; an engine fixedly attached to the rollable trolley, the engine having a rotary power output; a blade connected operatively to the engine's rotary power output for, upon movement of the first rollable trolley over the concrete slab, slotting said slab and drawing concrete cuttings therefrom; a shroud fixedly attached to the first rollable trolley, the shroud having a plurality of side walls, a floor, and a ceiling, the shroud housing the blade, and defining a dust containment space; an Archimedes' screw having input and output ends, the Archimedes screw's input end being positioned within the shroud's dust containment space; power transfer gears connected operatively to the Archimedes screw's for conveying the concrete cuttings from the Archimedes screw's input end to the output end; and a receptacle under the output end.

18 Claims, 3 Drawing Sheets

CONCRETE POWER SAW

FIELD OF THE INVENTION

This invention relates to power saws which typically rotatably drive a industrial grade diamond impregnated blades, such saws being adapted for cutting slots into concrete slab surfaces. More particularly, this invention relates to such saws which are adapted for collecting and handling emanations of concrete dust and cuttings during slot cutting operations.

BACKGROUND OF THE INVENTION

Conventional gasoline or electric motor driven concrete power saws are conventionally used for cutting slots or contraction joints within concrete slabs, such as concrete roadways, sidewalks, foundation floors, and tarmacs. During such cutting operations, concrete dust cuttings commonly and undesirably emanate from the cutting site to cover surfaces and foul the air. A primary component of concrete dust is silica, and breathing of such dust is known to contribute to onset of silicosis of the lungs. Due to concrete's common coal or fly ash content, concrete dust cuttings may also include toxic heavy metals and metalloids such as lead and arsenic. In addition to the harmful health effects of concrete dust, such dust is often difficult and time consuming to clean from floor surfaces and other surfaces such as vehicles and building fixtures and walls.

Known vacuum based systems for handling and reducing such concrete dust are undesirably mechanically complex and cumbersome, and are not economically provided.

The instant inventive concrete power saw solves or ameliorates the problems, defects, and deficiencies discussed above by providing specialized concrete dust capturing and conveying mechanisms which effectively reduce emanations of concrete dust without the provision of any vacuum actuated system or equipment.

BRIEF SUMMARY OF THE INVENTION

A first structural component of the instant inventive concrete saw comprises a rollable trolley. In a preferred embodiment, the rollable trolley comprises a rigid and substantially rectangular plate steel deck having a pair of fixed rear wheels, and having at least a first adjustable height front wheel. The adjustability of the trolley's front wheels facilitates adjustability of the cutting depth of the concrete saw machine and alternatively facilitates maintenance of a constant cutting depth as diameters of rotary blades vary.

A further structural component of the instant inventive concrete saw comprises motor means which are fixedly attached to the rollable trolley. In the preferred embodiment, the motor means are mounted directly upon an upper surface of the rollable trolley, the motor means utilizing the trolley as a support pedestal.

In a preferred embodiment, the motor means comprise a four cycle air cooled gasoline engine. Suitably, the motor means may alternatively comprise a two cycle engine. Also suitably, the motor means may further alternatively comprise an electric motor. For indoor operation, the motor means may suitably comprise a propane gas powered internal combustion engine. The motor means necessarily has a rotary power output which is at least utilized for rotatably driving the machine's saw blade. The motor means preferably further drives via provided secondary turning means the machine's below described dust conveying and apparatus.

A further structural component of the inventive concrete saw comprises a rotary concrete cutting blade. Preferably, the blade is of the type having impregnated industrial grade diamonds for longevity in concrete cutting use. In a preferred embodiment, the blade component is connected operatively to the motor means' rotary power output by a journal axle, belt, and pulleys combination, such combination positioning the blade for cutting impingement against underlying concrete slab surfaces.

A further structural component of the instant inventive concrete saw comprises a specially configured blade shroud which is preferably fixedly and rigidly mounted to a lateral side of the rollable trolley. The rigid mount of the shroud in combination with a rigid journal axle mount of the blade to the shroud and/or the trolley advantageously requires that blade positioning and movement be coincident with trolley positioning and movement.

In the preferred embodiment, the machine's shroud component has a plurality of side walls (preferably consisting of a lateral wall, an oppositely lateral wall, a front wall, a rear wall), a ceiling, and a floor. Preferably, the floor component comprises a slide plate which is adapted for dynamic vertical adjustment and movement. In the preferred embodiment, the combination of such shroud walls, ceiling, and floor forms, defines, and encloses a dust containment space which functions as a first stage handling space for minimization of emanations of concrete dust during concrete saw cutting.

A further structural component of the instant inventive concrete saw comprises an Archimedes' screw which operates similarly with a tube mounted helical blade auger for conveyance of granular materials. The Archimedes' screw component preferably comprises a hollow tube which receives and rotatably houses a helically bladed bit or screw. In the preferred embodiment, the lower and forward input end of the Archimedes' screw is configured integrally with the blade shroud so that the Archimedes' screw is forwardly supported and so that its input end resides within the shroud's dust containment space.

Further structural components of the instant inventive concrete saw comprise the secondary turning means which are connected operatively to the opposite output end of the Archimedes' screw component, such opposite end preferably being positioned upwardly and rearwardly from the shroud. Suitably, the turning means may comprise a secondary and separate electric motor or internal combustion engine whose rotary power linkage is connected to the output end of the Archimedes screw's helical bit. However, in the preferred embodiment, the turning means derives its rotary power from the rotary power output of the machine's primary motor means. In a preferred embodiment, a drive linkage comprising a second belt and pulleys combination in further combination with a rotational power redirecting gear train is provided for rotatably driving the Archimedes' screw. Accordingly, the instant invention advantageously allows a single engine to simultaneously rotatably drive the machine's blade (which generates the concrete dust) and drive the Archimedes' screw (which conveys the concrete dust).

A further Component of the instant inventive concrete saw comprises a receptacle for the receiving concrete saw cuttings. In the preferred embodiment, the receptacle comprises a bin which rolls upon and is supported by a second rollable trolley, such trolley moving in train with the first rollable trolley. Preferably, the output end of the Archimedes' screw is equipped with an output chute which may be downwardly directed for communication with an upper opening of the receptacle.

In operation of the instant inventive concrete saw, the Archimedes' screw preferably continually turns during concrete sawing operations. Concrete dust and cuttings, which are continuously drawn and thrown by the rotary blade from the sawn slot and into the shroud's dust containment space, advantageously fall into or are directed into the Archimedes' screw's input end. Continuous rotation of the Archimedes' screw's helical screw flights carries such saw cuttings upwardly and rearwardly along the tube to emit into the chute, and to fall downwardly therethrough into the trailing receptacle.

As a result of operation of the inventive saw, dust emanations at and about the slot cutting site are minimized with the majority of the concrete cuttings being conveyed into and stored within the receptacle for proper disposal.

Accordingly, objects of the instant invention include the provision of a concrete cutting saw which incorporates structures, as described above, and which arranges those structures in relation to each other, in manners described above, for achievement of the beneficial functions described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
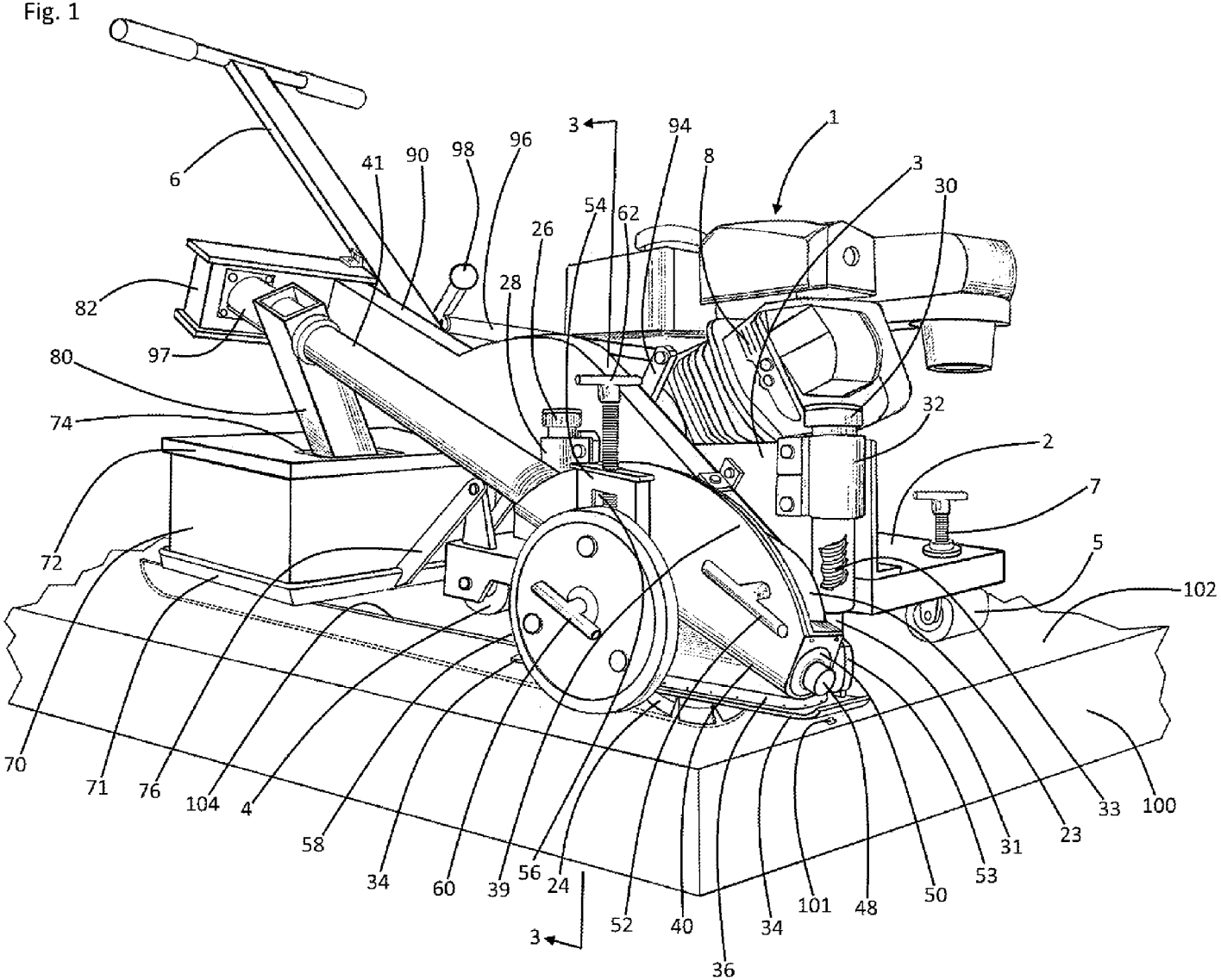
FIG. 1 is a perspective view of a preferred embodiment of the instant inventive concrete saw.

Referring now to the drawings and in particular to Drawing FIG. 1, a preferred embodiment of the instant inventive concrete saw is referred to generally by Reference Arrow 1. The saw 1 preferably comprises a first trolley 2 having a pair of rear wheels 4, and at least a first front wheel 5. In the preferred embodiment, the front wheel 5 is equipped with a height adjustment screw 7 for selective adjustment of the elevation of the front edge of the first trolley 2 with respect to the upper surface of a concrete slab 100, such height adjustment enabling alterations and maintenance of the saw's cutting depth in a manner discussed below.

Referring further to FIG. 1, a gasoline powered internal combustion engine 8 is securely mounted to the upper surface of the deck of the rollable trolley 2. Such engine 8 is intended as being representative of other suitable motor means such as electric motors which are considered to fall within the scope of the invention.

Referring simultaneously to all figures, a concrete cutting blade 24 is connected operatively to the rotary drive output 10 of the engine 8. The blade 24 is rotatably mounted by means of a journal axle 22 which extends through an aperture 51 within a left or oppositely lateral shroud wall 19, which itself is rigidly connected to the trolley 2 by means of "L" flange 3 and connector arm 18. The oppositely lateral end of axle 22 is rotatably supported upon the lateral end of trolley 2 by rotary bearing 49. A pulleys 12 and 16, and belt 14 combination, translates rotary power from the engine's rotary output 10 to the axle 22 and to the blade 24.

Figure 3:
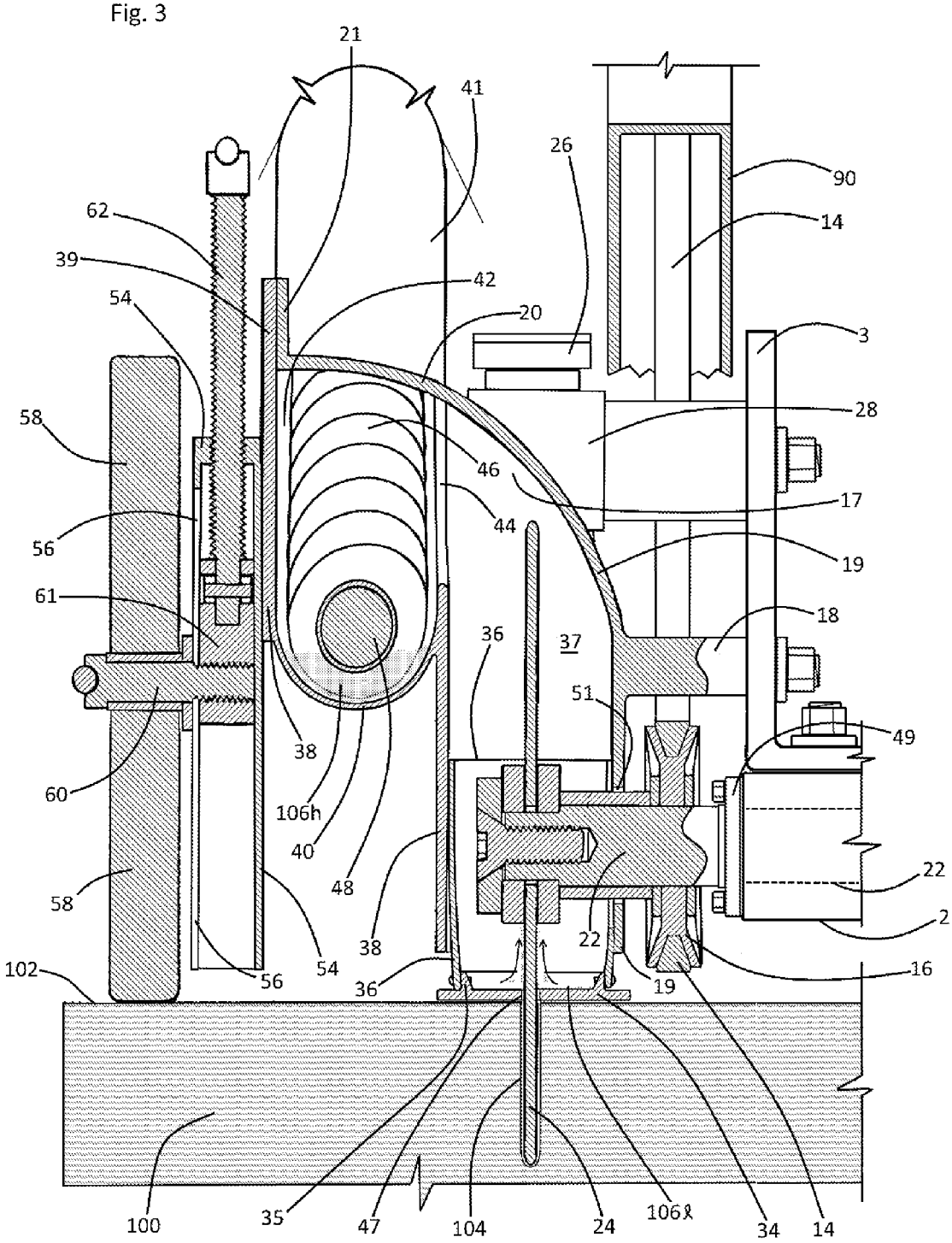
FIG. 3 is a partial sectional view as indicated in FIG. 1.

Referring simultaneously to FIGS. 1 and 3, the blade shroud has a lateral side wall 38, an oppositely lateral side wall 19, a ceiling 20, a back wall 17, a front wall 23, and a slide plate configured floor 34. Such combination of walls 38,19,17,23, ceiling 20, and floor 34 advantageously forms and defines a dust containment space 37. In a preferred embodiment, the ceiling 20 is arcuately curved so that concrete dust 106*l* which is thrown and churned within the containment space 37 is directed upwardly and laterally through port 44 for handling and conveyance in the manner described below.

An Archimedes' screw component preferably comprising a hollow tube 41, a drive axle 48, and a helical screw flight 46, is necessarily provided. A lower intake end of the Archimedes' screw 41,46,48 is preferably positioned at and opens into the shroud's interior dust containment space 37. In the preferred embodiment, the shroud's lateral wall 38 is laterally stepped or offset at an elevation above the slide plate floor 34 and below the ceiling 20, such offset advantageously forming a dust collecting land 40.

In the preferred embodiment, the shroud's dust collecting land 40 is concavely configured to present a cylindrical curvature which is closely fitted for nesting receipt of the cylindrical periphery of the helical blade flights 46. In the preferred embodiment, the forward end of the Archimedes' screw's drive axle 48 is supported by a rotary bearing 50 which is mounted to the shroud's front wall 23, such bearing 50 effectively closing the forward end of the tube 40,41.

The shroud 38,20,19,23,34 is preferably longitudinally seamed to divide the shroud into separable lateral and oppositely lateral "clamshell" segments. In the preferred embodiment, the lateral segment includes the lateral wall 38, the curved dust collecting land 40, and the rotary bearing 50, the input end of the Archimedes' screw component preferably being integral with such lateral shroud segment. The oppositely lateral segment of the shroud preferably comprises the lateral wall 19 in combination with the curved ceiling 20. Hand turnable attachment screws 52 which extend through mounting flanges 39 and 21 are preferably provided for removably connecting the shroud's lateral and oppositely lateral segments. Such "clamshell" mode of connection of the shroud's segments facilitates easy access to the blade 24 for mechanical maintenance.

Figure 2:
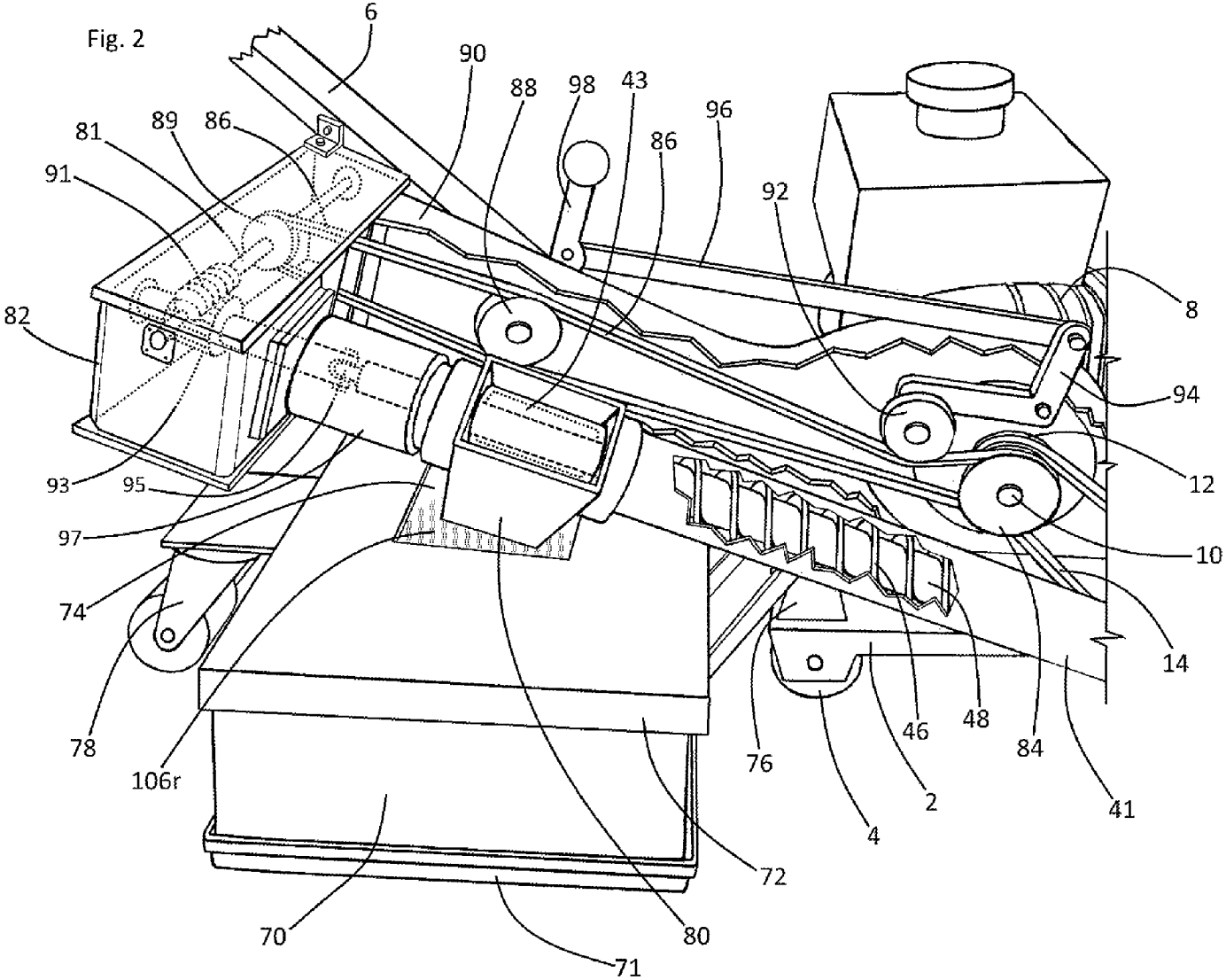
FIG. 2 redepicts in magnified view a portion of the structure presented in FIG. 1, the view of FIG. 2 including cutaway sections and dashed line structures in explanation of internal mechanical components.

Referring in particular to FIG. 2, the rearward end of the Archimedes' screw preferably includes an output port 43 (shown as a dotted line) which opens tube 41. An output chute 80 communicates with such port 43 for directing the concrete cuttings and dust output of the Archimedes' screw through an upper port 74 of a rearwardly trailing concrete dust receptacle 70.

The rearward end of the axle 48 of the Archimedes' screw is preferably rotatably driven by turning means, preferably in the form of a belt 86 and pulleys 84,88,89 combination. Such belt and pulleys combination translates rotary power from the engine's rotary power output 10 to a transverse axle 81 which is rotatably mounted within a power transfer box 82. The transverse axle 81 rotatably drives a worm gear 91 which engages and turns a pinion gear 93 which is axially joined with the Archimedes' screw's drive axle 48. A universal joint 95 advantageously accommodates for angular deflections of the Archimedes' screw with respect to the power transfer box 82. The universal joint 95 further facilitates disassembly and disconnection of the clamshell halves of the shroud without requiring disconnection of the drive shaft 48. A flexible boot 97 is provided to facilitate such clamshell disconnection. A belt and pulley shroud 90 is preferably provided for protecting operators from pinch points inherent in such power transfer system.

The Archimedes' screw's turning means preferably incorporates a tensioning pulley 92 mounted upon a pivot arm 94. Such tensioning pulley 92 may be actuated by hand manipulation of lever 98 which rotates the pivot arm 94 via bar linkage 96. Rearward pivoting of lever 98 engages the turning means by tightening the belt 86 against drive pulleys 89 and 84. Forward deflection of lever 98 raises the tensioning pulley 92, causing the belt 86 to slacken to allow continued rotary motion of the rotary power output 10 while the axle 48 and its screw flights 46 remain motionless. Pulley 88 constitutes an idler pulley which continues to guide belt 86 while such belt is frictionally disengaged.

While the mechanical combination of the belt 86, pulleys 89, 88, 92, and 84, transverse axle 81, worm gear 91, and pinion gear 93 constitutes a preferred means for turning the Archimedes' screw axle 48, other turning means such as an independent electric motor or an independent internal combustion engine are considered to fall within the scope of the invention. Other variously configured and commonly known rotary power redirecting drive trains, such as bevel gear and drive axle combinations, are also considered to fall within the scope of the invention. The depicted belt, pulleys, and gears turning means combination is intended as being representative of such alternative turning means.

Referring simultaneously to FIGS. 1 and 2, a height adjustable lateral wheel 58 is preferably provided, such wheel 58 being rotatably mounted upon a journal axle 60 whose lateral end is configured as a hand turnable "T" for operator assembly and disassembly. The oppositely lateral end of the journal axle 60 is preferably helically threaded for removably engaging a slide block 61. Block 61 is preferably slidably received within a slide mount 54 which exposes the block 61 and axle 60 beneath a vertical slide slot 56. Clockwise and counterclockwise turning of jack screw 62 selectively raises and lowers the wheel 58. In a preferred mode of operation, screws 62 and 7 are turned in a coordinated fashion so that the lower ends of wheels 58 and 6 reside at a common elevation with respect to the deck of trolley 2. Such coordination of adjustable heights maintains blade 24 at a perpendicular orientation with respect to the upper surface 102 of the concrete slab 100 while allowing the machine's operator to precisely control the depth of a concrete slot 104 which is cut by blade 24. As the diameter of blade 24 varies due to wear, such coordinated manipulation of screws 62 and 7 may assure slot depth consistency during prolonged usage of the machine 1.

Referring further simultaneously to FIGS. 1 and 2, the slide plate configured floor 34 has a blade slot 47. The shroud is preferably specially adapted for alternative upward and downward telescoping motion of the plate 34 and slot 47 with respect to the lower ends of the side walls 38 and 19, rear wall 17, and front wall 23 of the shroud. In order to facilitate such telescoping motion, an upwardly extending elastomeric flange 36 is preferably attached to the slide plate 34, such flange's lower end being fixedly attached to a peripherally extending mounting ridge 35. In the preferred embodiment, the elastomeric flange 36 is closely fitted to the inner dimensions of the walls 38, 19, 17, and 23 so that concrete dust **106*l*** does not escape between the peripheral seam formed between such flange and such walls.

The telescoping means which facilitate the upward and downward motions of the slide plate 34 preferably further comprise front and rear spring biased quill and shaft combinations 26 and 30, such quill and shaft combinations being rigidly mounted to the first trolley 2 by means of the rigidly mounted "L" flange 3 and rigid oppositely laterally extending bracket arms 28 and 32. Springs 33 which co-axially receive shafts 31 within the quill portions of the quill and shaft combinations 26 and 30 advantageously allow the lower ends of such shafts 31 to float upwardly and downwardly in a spring damped and normally downwardly extended fashion. Such shaft lower ends are preferably pivotally attached to the oppositely lateral edge of slide plate 34 by front and rear pivot mounts 53 (the rear pivot mount not being within views).

In operation of the above described slide plate telescoping means, a pebble 101, for example, may reside on the slab surface 102 in front of slide plate 34. Pebble 101 is intended as being representative of small changes or fluctuations in the grade or surface texture of the concrete surface 102. Upon contact of the forward end of the slide plate 34 with the pebble 101, the front end of the slide plate 34 deflects upwardly, driving shaft 31 upwardly against spring 30. Simultaneously, the sealing flange 36 slidably moves against the interior surfaces of the shroud's side walls without any breakage or interruption of the flange's dust sealing function. Continued forward passage of the slide plate 34 over pebble 101 allows the front end of the slide plate 34 to normally counter-deflect downwardly (through the action of the front quill and shaft combination 30) while the rearward end of the slide plate 34 in succession deflects upwardly (through the action of the rear quill and shaft combination 26). Accordingly, the telescoping means associated with the slide plate 34 advantageously allow the machine and the slide plate 34 to move over small concrete surface irregularities and protuberances, such as pebble 101, while continuously performing dust containment and sealing, and without any gross disturbance or variation of the cutting depth of the blade 24.

Referring simultaneously to FIGS. 1 and 2, to effectively collect and temporarily store concrete dust cuttings, the receptacle 70 having a removable lid 72 is preferably mounted upon and carried by a second rollable trolley 71. Such second trolley is preferably rearwardly supported by a rear caster wheel 78, and is forwardly supported and towed by bracket arms 76 which securely and pivotally interconnect the second trolley 71 with the first trolley 2.

Referring simultaneously to all figures, the machine's operator may, for example, desire to cut a one inch depth expansion slot 104 within a concrete slab 100. Accordingly, the operator may turn "T" handle screws 62 and 7 until the lower ends of wheels 58 and 5 upwardly retract to the elevation which overlies that of the lower end of blade 24 by one inch. Thereafter, engine 8 may be actuated, and lever 98 may be pulled rearwardly, causing the Archimedes' screw turning belt 86 to frictionally engage and rotatably drive the helical bit 46 and axle 48 within tube 41. Upon lowering of the blade 24 into the surface 102 of the concrete slab 100, the blade 24 draws and throws (in the upward direction indicated by the arrows drawn upon FIG. 3) concrete dust and cuttings **106*l* into the interior space 37 of the shroud. Continued rotary motion of the blade 24 minimizes accumulations of concrete dust 106*l* upon floor 34, such blade continually churning and rapidly throwing the dust within and about such space. Such rotary motion and dust throwing effect causes portions of the dust to continuously impinge against the curved ceiling 20. The curved ceiling 20 advantageously causes the dust 106*l* to carom laterally through port 44 to fall laterally and downwardly over the curved dust capturing land 40 to accumulate therein as concrete dust 106*h***.

The continuous rotary turning of the screw flights 46 within the interior space 42 of the tube 41 draws such dust **106*h* upwardly and rearwardly through tube 41 to emit through outlet port 43, such dust immediately falling downwardly through chute 80 and into and through 72 of receptacle 70 to reside as collected dust 106***r*. As the slot cutting progresses along the slab 100, such dust collection and Archimedes' screw actuated dust conveyance continues, advantageously preventing harmful emanations of concrete dust at and about the cutting site.

To assist an operator in guiding the machine 1 along the path of slot 104, a "T" handle 6 is preferably rigidly mounted to the rearward end of the rollable trolley 2.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope at least commensurate with the appended claims.

The invention hereby claimed is:

1. A concrete saw for cutting a concrete slab, the concrete saw comprising:

(a) a first rollable trolley having upper, lateral, front, and rear ends;

(b) a motor fixedly attached to the first rollable trolley, the motor having a rotary power output;

(c) a blade connected operatively to the motor's rotary power output for, upon movement of the first rollable trolley over the concrete slab, slotting said slab and drawing concrete cuttings therefrom;

(d) a shroud fixedly attached to the first rollable trolley, the shroud having a plurality of side walls, a floor, and a ceiling, the shroud housing the blade and defining a dust containment space;

(e) an Archimedes' screw having input and output ends, the Archimedes' screw's input end being positioned within the shroud's dust containment space;

(f) a drive linkage connected operatively to the Archimedes' screw for conveying the concrete cuttings from the Archimedes' screw's input end to the Archimedes' screw's output end; and (g) a receptacle underlying the Archimedes' screw's output end.

2. The concrete saw of claim 1 wherein the shroud's side walls comprise a lateral wall and an oppositely lateral wall, the shroud's lateral wall forming an upwardly facing cuttings capturing land.

3. The concrete saw of claim 2 wherein the Archimedes' screw comprises a helical blade having a cylindrical outer periphery, and wherein the cuttings capturing land is closely fitted for nesting receipt of said blade's cylindrical outer periphery.

4. The concrete saw of claim 3 wherein the shroud's ceiling is arcuately curved.

5. The concrete saw of claim 4 wherein the Archimedes' screw has an axial drive shaft having a front end, and further comprising a rotary bearing mounted to the shroud's front wall, the rotary bearing supporting the axial drive shaft's front end.

6. The concrete saw of claim 5 further comprising a seam, the seam segmenting the shroud into lateral and oppositely lateral segments, and further comprising releasable fasteners, the releasable fasteners interconnecting the shroud's lateral and oppositely lateral segments.

7. The concrete saw of claim 6 wherein the drive linkage comprises a belt and pulleys combination, said combination being connected operatively to the motor's rotary power output.

8. The concrete power saw of claim 7 wherein the Archimedes' screw's axial drive shaft has a rearward end, and wherein the drive linkage further comprises a rotary power directing gear train, said gear train operatively interconnecting the drive linkage's belt and pulleys combination and the axial drive shaft's rearward end.

9. The concrete saw of claim 8 wherein the shroud's floor comprises a slide plate having a slot, the blade being received within the slot.

10. The concrete saw of claim 9 further comprising a telescoping flange operatively interconnecting the shroud's slide plate and the shroud's side walls, the telescoping flange being adapted for facilitating alternative upward and downward movements of the slide plate with respect to the side walls.

11. The concrete saw of claim 10 wherein telescoping flange comprises a cuttings sealing flange fixedly attached to and extending upwardly from the slide plate, the cuttings sealing flange being closely fitted for receipt between the shroud's side walls.

12. The concrete saw of claim 11 wherein the telescoping flange further comprises front and rear spring damped quill and shaft combinations, said combinations operatively interconnecting the shroud's slide plate and the first rollable trolley.

13. The concrete saw of claim 9 further comprising a lateral support wheel and a height adjustment mechanism, the height adjustment mechanism interconnecting the lateral support wheel and the shroud's lateral segment.

14. The concrete saw of claim 13 wherein the height adjustment mechanism is adapted for selectively upwardly and downwardly positioning the lateral support wheel with respect to the shroud.

15. The concrete saw of claim 14 wherein the height adjustment mechanism comprises a jack screw, slide slot, and slide block combination, and further comprise a journal axle, the journal axle being removably attached to said combination's slide block.

16. The concrete saw of claim 9 further comprising an output chute mounted to the Archimedes' screw in communication with the Archimedes' screw's output end.

17. The concrete saw of claim 16 wherein the receptacle comprises a second rollable trolley, the second rollable trolley being fixedly attached to the rearward end of the first rollable trolley.

18. The concrete saw of claim 17 wherein the receptacle has an open upper end, wherein the chute has a lower end, and wherein the chute's lower end extends into the receptacle's open upper end.

* * * * *